US006348005B1

(12) United States Patent
Tseng

(10) Patent No.: US 6,348,005 B1
(45) Date of Patent: Feb. 19, 2002

(54) SWING ASSEMBLY WITH CONVERTIBLE SEAT

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 09/797,304

(22) Filed: Mar. 1, 2001

(51) Int. Cl.[7] ..... A63G 9/00
(52) U.S. Cl. ..... 472/118; 472/125; 5/37.1
(58) Field of Search ..... 472/118, 119, 472/120, 121, 122, 123, 124, 125; 5/37.1, 125, 126, 127; 297/273, 354.13

(56) References Cited

U.S. PATENT DOCUMENTS 1,214,854 A * 2/1917 Weil ..... 472/124
1,406,737 A * 2/1922 Hoy ..... 5/124
3,161,893 A * 12/1964 Siler ..... 5/120
5,564,987 A * 10/1996 Ayrolles ..... 472/118
6,036,605 A * 3/2000 Tseng ..... 472/118

* cited by examiner

*Primary Examiner*—Kien T. Nguyen
(74) *Attorney, Agent, or Firm*—Ladas & Parry

(57) ABSTRACT

A swing assembly includes a support frame unit with two side legs and a horizontal bar interconnecting the side legs, a seat unit, and linking units for suspending the seat unit. The seat unit includes a rectangular base frame connected to lower ends of the linking unit. The base frame includes a pair of lateral frame sections, and front and rear rods interconnecting the lateral frame sections. A seat frame has a front end portion resting on the front rod, and a rear end portion connected pivotally to a front end portion of a backrest frame, which is pivoted to the lateral frame sections of the base frame so as to be pivotable relative to the seat frame and the base frame for moving between a flat position, in which a rear end portion of the backrest frame rests on the rear rod, and an inclined position, in which the rear end portion of the backrest frame is raised to be disposed above the rear rod. A backrest support has an upper end pivoted to an intermediate portion of the backrest frame. A retaining unit is mounted on the rear rod for releasably retaining a lower end of the backrest support so as to retain releasably the backrest frame at the inclined position.

4 Claims, 4 Drawing Sheets

SWING ASSEMBLY WITH CONVERTIBLE SEAT

BACKGROUND OF THE INVENTION

1. Field of the Invention

The present invention relates to a swing assembly, more particularly to a swing assembly with a seat which is convertible from a chair into a bed and vice versa.

2. Description of the Related Art

A conventional swing assembly generally includes a pair of spaced-apart side legs, a horizontal hanger bar interconnecting upper ends of the side legs, and a seat unit disposed among the side legs and the hanger bar and suspended on the hanger bar via a pair of linking units. The seat unit typically includes a seat part and a backrest part fixed to the seat part at a certain angular position so as to support the back of a person seated thereon. However, the seat unit provided in the conventional swing assembly can only serve as a chair. It is desirable that the seat unit be convertible so as to be capable of serving as a chair or a bed to enhance the utility of the swing assembly.

SUMMARY OF THE INVENTION

Therefore, the main object of the present invention is to provide a swing assembly with a convertible seat unit which is capable of serving as a chair or a bed.

Accordingly, the swing assembly of the present invention includes a support frame unit, a pair of linking units, and a seat unit. The support frame unit includes a pair of spaced-apart side legs with lower end portions adapted to be supported on a ground surface, and upper end portions, and a horizontal bar interconnecting the upper end portions of the side legs. The linking units are spaced-apart along a longitudinal direction of the horizontal bar. Each of the linking units has an upper end connected pivotally to the horizontal bar, and a lower end. The seat unit is disposed among the side legs and the horizontal bar, and includes a rectangular base frame, a seat frame, a backrest frame, a backrest support, and a retaining unit. The base frame is connected pivotally to the lower ends of the linking units, and has a pair of lateral frame sections disposed adjacent to the side legs, respectively, and front and rear rods parallel to the horizontal bar and interconnecting the lateral frame sections. The seat frame has a front end portion resting on the front rod of the base frame, and a rear end portion. The backrest frame has a front end portion connected pivotally to the rear end portion of the seat frame, a rear end portion, and an intermediate portion between the front and rear end portions of the backrest frame. The backrest frame is further pivoted to the lateral frame sections of the base frame so as to be pivotable relative to the seat frame and the base frame for moving between a flat position, in which the rear end portion of the backrest frame rests on the rear rod of the base frame and in which the backrest frame is coplanar with the seat frame, and an inclined position, in which the rear end portion of the backrest frame is raised to be disposed above the rear rod of the base frame and in which the backrest frame is inclined relative to the seat frame. The backrest support has an upper end pivoted to the intermediate portion of the backrest frame, and a lower end. The retaining unit is mounted on the rear rod of the base frame for releasably retaining the lower end of the backrest support so as to retain releasably the backrest frame at the inclined position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
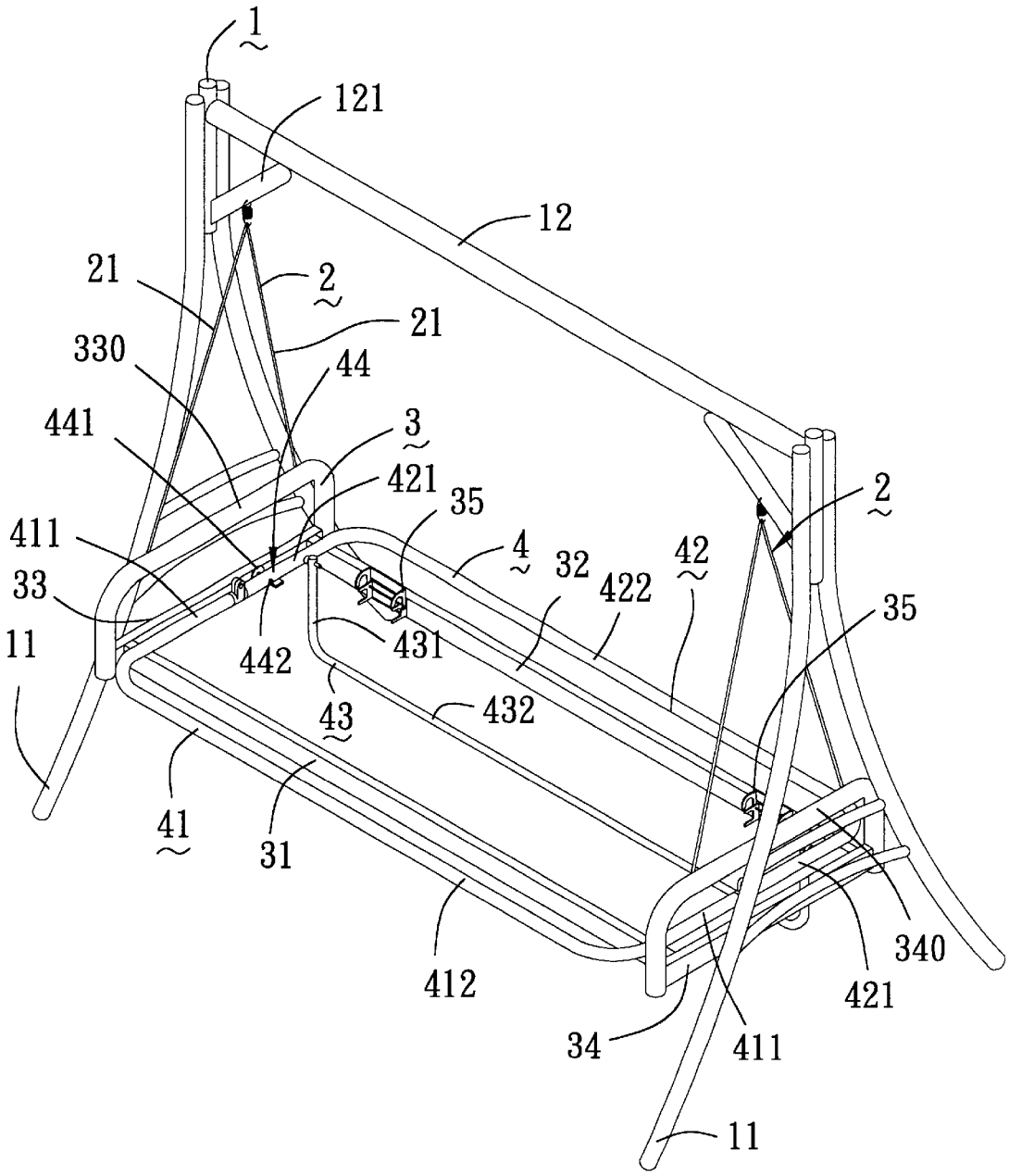
FIG. 1 is a perspective view of a preferred embodiment of the swing assembly of the present invention.
Figure 2:
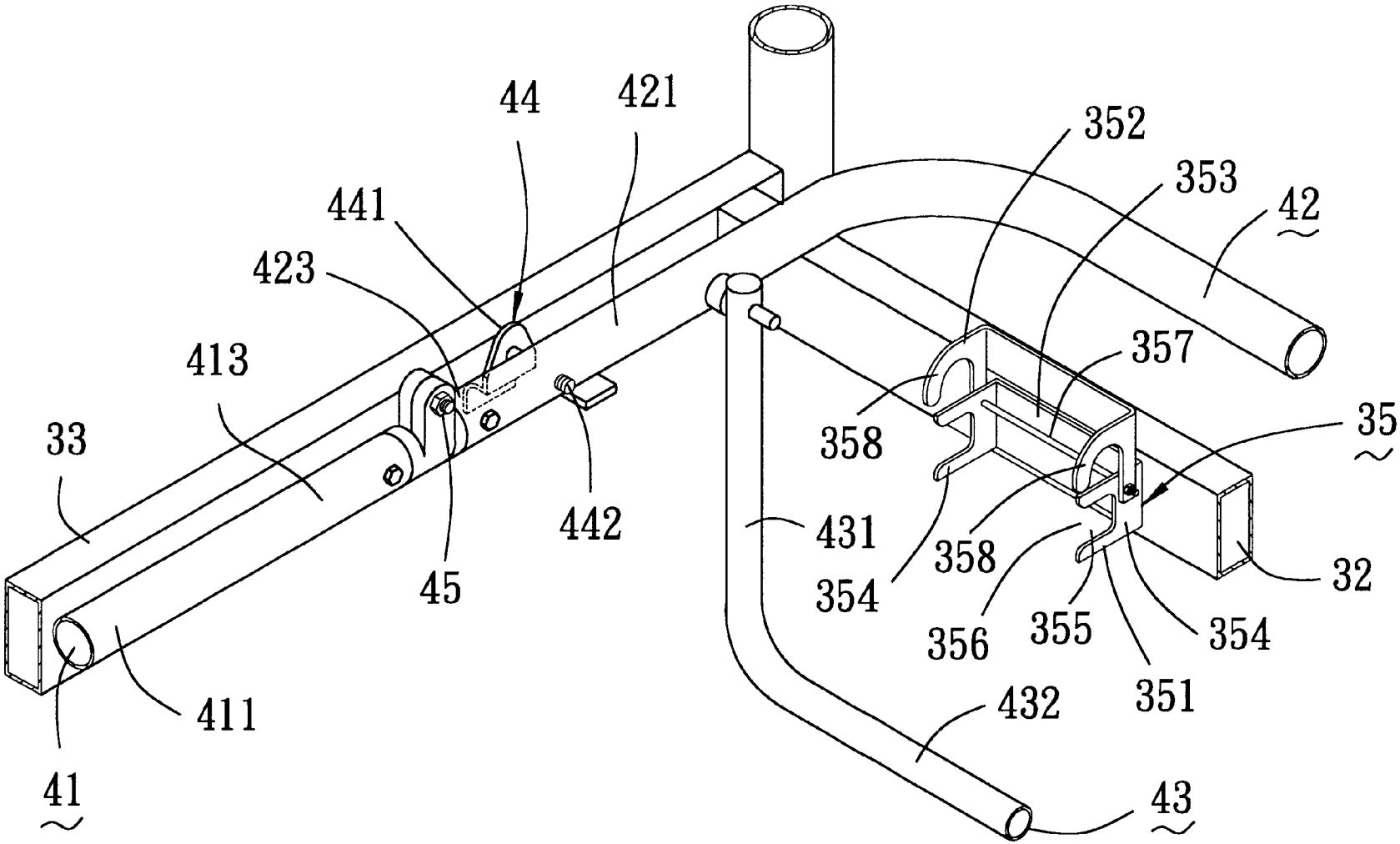
FIG. 2 is a fragmentary perspective view illustrating a seat unit of the swing assembly of the preferred embodiment.

Referring to FIGS. 1 and 2, the preferred embodiment of the swing assembly according to the present invention is shown to include a support frame unit 1, a pair of linking units 2, and a seat unit 4.

The support frame unit 1 includes a pair of spaced-apart side legs 11 with lower end portions adapted to be supported on a ground surface, and a horizontal bar 12 interconnecting upper end portions of the side legs 11.

The linking units 2 are spaced-apart along a longitudinal direction of the horizontal bar 12. Each of the linking units 2 includes a pair of linking chains 21 having upper ends connected pivotally to an inclined hanger rod 121 which extends between a respective end portion of the horizontal bar 12 and the upper end portion of the adjacent side leg 11.

The seat unit 4 is disposed among the side legs 11 and the horizontal bar 12, and includes a rectangular base frame 3, a seat frame 41, a backrest frame 42, a backrest support 43, and a pair of retaining units 35. The base frame 3 includes a pair of lateral frame sections, each of which is disposed adjacent to a respective one of the side legs 11 and includes an inverted U-shaped head frame 330, 340 and a cross-bar 33, 34 extending across parallel upright portions of the head frame 330, 340. The base frame 3 further includes front and rear rods 31, 32 parallel to the horizontal bar 12 and interconnecting the cross-bars 33, 34 of the lateral frame sections. The head frame 330, 340 of each of the lateral frame sections of the base frame 3 is connected pivotally to lower ends of the linking chains 21 of a respective one of the linking units 2 such that the base frame 3 is swingable forwardly and rearwardly within a space among the side legs 11 and the horizontal bar 12.

The seat frame 41 is generally U-shaped, and has a front end portion resting on the front rod 31 of the base frame 3, and formed with a front linking rod 412 parallel to the front rod 31. The seat frame 41 further has a pair of lateral rods 411 extending rearwardly from opposite ends of the front linking rod 412 and having rear end portions 413. The backrest frame 42 is generally U-shaped, and has a rear end portion formed with a rear linking rod 422 parallel to the rear rod 32 of the base frame 3, and a pair of side arms 421 which extend forwardly from opposite ends of the rear linking rods 422 and which have front end portions 423 that are connected pivotally to the rear end portions 413 of the lateral rods 411 of the seat frame 41 by means of a pair of horizontal pivot shafts 45 parallel to the front and rear rods 31, 32. The side arms 421 of the backrest frame 42 are further pivoted to the cross-bars 33, 34 of the lateral frame sections of the base frame 3 by means of a pair of pivot units 44, each of which includes a mounting plate 441 fastened to an inner side of a respective one of the cross-bars 33, 34 and projecting upwardly from the respective cross-bar 33, 34, and a pivot pin 442 extending through the respective side arm 421 and the mounting plate 441 and into the respective cross-bar 33, 34. The pivot pins 442 are disposed posteriorly of the pivot shafts 45.

The backrest support 43 is formed as a U-shaped support rod with parallel lateral rod portions 431 and a connecting rod portion 432 interconnecting lower ends of the lateral rod portions 431 and parallel to the horizontal bar 12. Each of the lateral rod portions 431 has an upper end connected pivotally to an intermediate portion of a respective one of the side arms 421 of the backrest frame 42 at a point posteriorly of the pivot pin 442 such that the backrest support 43 is pivotable about a horizontal axis parallel to the pivot pins 442 and the pivot shafts 45.

The retaining units 35 are mounted on an inner side of the rear rod 32 and are spaced-apart along a longitudinal direction of the rear rod 32. Each of the retaining units 35 includes a retaining seat 351 and a limiting member 352. The retaining seat 351 is formed by bending a metal plate, and includes a fixed plate portion 353 attached and fixed to the rear rod 32, and a pair of wing portions 354 projecting forwardly from two opposite edges of the fixed plate portion 353. The wing portions 354 are spaced-apart along the longitudinal direction of the rear rod 32, and are each formed as a U-shaped plate that defines a retaining groove 355 with an access opening 356 which opens forwardly. The limiting member 352 has a lower end mounted pivotally on the retaining seat 351 by means of a pivot axle 357 parallel to the rear rod 32, and a pair of limiting hooks 358 which project downwardly and forwardly from an upper end of the limiting member 352.

Figure 3:
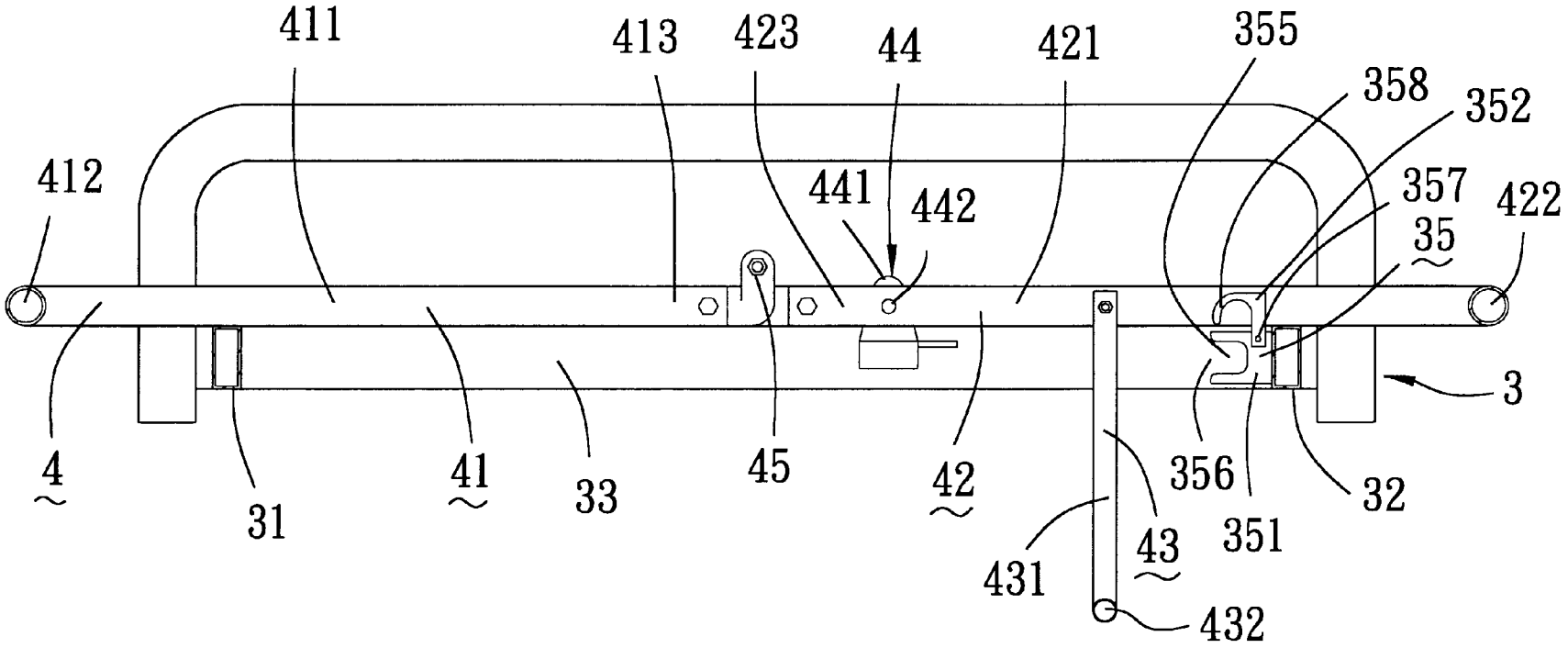
FIG. 3 is a schematic side view illustrating the seat unit when the seat unit is in the state of a bed.
Figure 4:
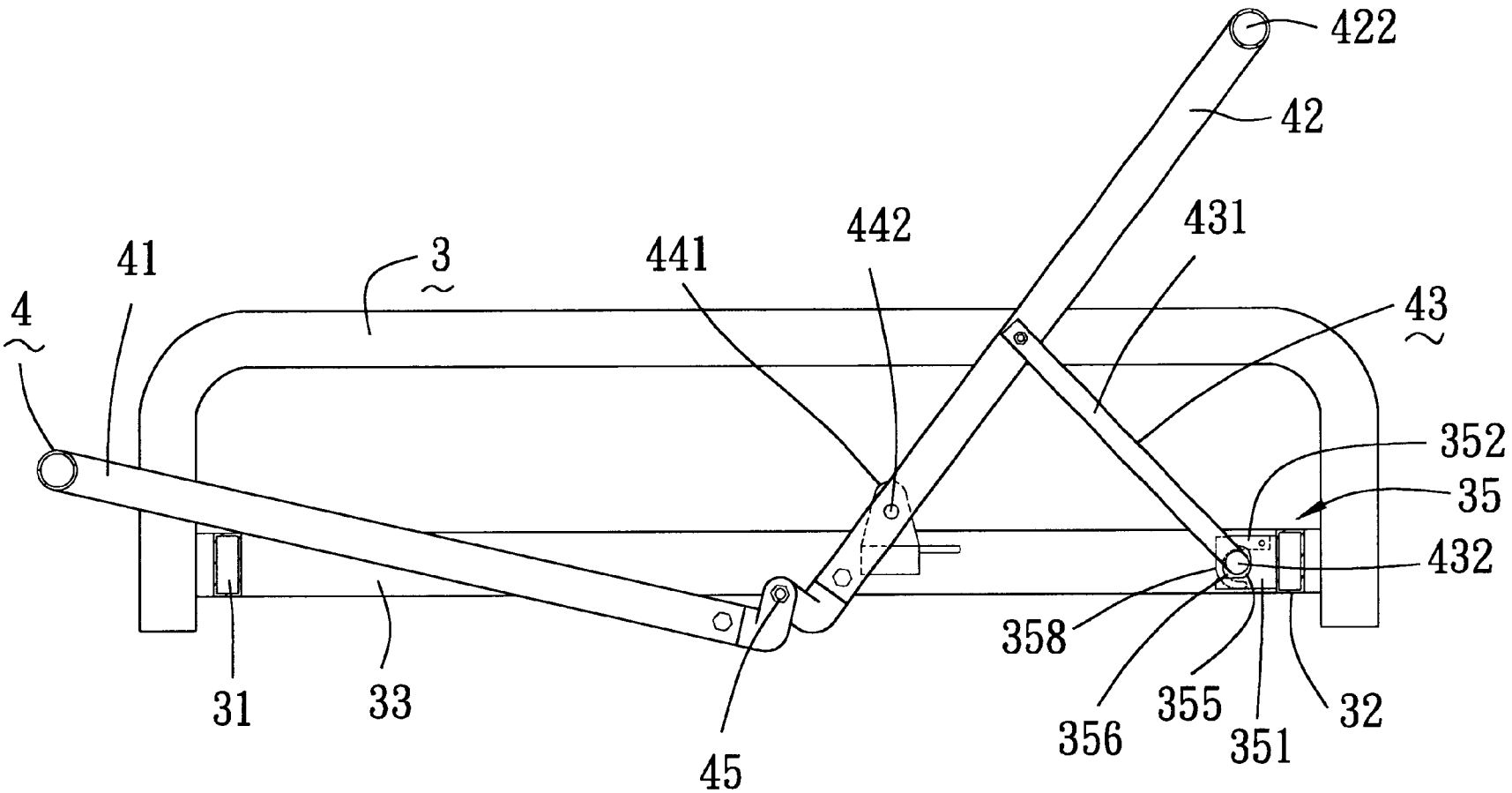
FIG. 4 is a schematic side view illustrating the seat unit when the seat unit is in the state of a chair.

Referring to FIGS. 3 and 4, when the seat unit 4 is to be used as a bed during use of the swing assembly, the backrest frame 42 is disposed in a flat position shown in FIG. 3, in which the rear end portion of the backrest frame 42 rests on the rear rod 32 and in which the backrest frame 42 is coplanar with the seat frame 41. To convert the seat unit 4 from the bed into a chair, the backrest frame 42 is turned forwardly relative to the cross-bars 33, 34 of the base frame 3 and relative to the seat frame 41 for moving to an inclined position shown in FIG. 4, in which the rear linking rod 422 on the rear end portion of the backrest frame 42 is raised to be disposed above the rear rod 32 of the base frame 3 and in which the backrest frame 42 is inclined relative to the seat frame 41. The limiting members 352 of the retaining units 35 are initially disposed in an unlocking position, as shown in FIGS. 2 and 3, in which the access openings 356 of the retaining grooves 355 are uncovered by the limiting hooks 358 to permit movement of the connecting rod portion 432 of the backrest support 43 into and out of the retaining grooves 355 via the access openings 356. The connecting rod portion 432 of the backrest support 43 is then extended into the retaining grooves 355 via the access openings 356. Thereafter, the limiting members 352 are turned downwardly relative to the retaining seats 351 for moving to a locking position, as shown in FIG. 4, in which the limiting hooks 358 block the access openings 356 and hook onto the connecting rod portion 432, thereby preventing removal of the connecting rod portion 432 from the retaining grooves 355 so as to retain releasably the connecting rod portion 432 and to retain releasably the backrest frame 42 at the inclined position.

It has thus been shown that, by turning the backrest frame 42 forwardly and upwardly and by engaging the connecting rod portion 432 of the backrest support 43 with the retaining grooves 355 in the retaining seats 351, the seat unit 4 can be converted into a chair. On the other hand, by turning the limiting members 352 of the retaining units 35 upwardly for unlocking the connecting rod portion 432, the connecting rod portion 432 is removable from the retaining units 35 to permit the backrest frame 42 to rest on the rear rod 32 of the base frame 3, thereby converting the seat unit 4 into a bed.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A swing assembly comprising:

a support frame unit including a pair of spaced-apart side legs with lower end portions adapted to be supported on a ground surface, and upper end portions, and a horizontal bar interconnecting said upper end portions of said side legs;

a pair of linking units spaced-apart along a longitudinal direction of said horizontal bar, each of said linking units having an upper end connected pivotally to said horizontal bar, and a lower end; and a seat unit disposed among said side legs and said horizontal bar, said seat unit including:

a rectangular base frame connected pivotally to said lower ends of said linking units, said base frame including a pair of lateral frame sections disposed adjacent to said side legs of said support frame unit, respectively, and front and rear rods parallel to said horizontal bar and interconnecting said lateral frame sections;

a seat frame having a front end portion resting on said front rod of said base frame, and a rear end portion;

a backrest frame having a front end portion connected pivotally to said rear end portion of said seat frame, a rear end portion, and an intermediate portion between said front and rear end portions of said backrest frame, said backrest frame being further pivoted to said lateral frame sections of said base frame so as to be pivotable relative to said seat frame and said base frame for moving between a flat position, in which said rear end portion of said backrest frame rests on said rear rod of said base frame and in which said backrest frame is coplanar with said seat frame, and an inclined position, in which said rear end portion of said backrest frame is raised to be disposed above said rear rod of said base frame and in which said backrest frame is inclined relative to said seat frame;

a backrest support having an upper end pivoted to said intermediate portion of said backrest frame, and a lower end; and a retaining unit mounted on said rear rod of said base frame for releasably retaining said lower end of said backrest support so as to retain releasably said backrest frame at the inclined position.

2. The swing assembly as claimed in claim 1, wherein said front end portion of said backrest frame is pivoted to said rear end portion of said seat frame so as to be pivotable about a first pivot axis parallel to said horizontal bar, said backrest frame being pivoted to said lateral frame sections of said seat frame about a second pivot axis which is parallel to said horizontal bar and which is disposed posteriorly of said first pivot axis.

3. The swing assembly as claimed in claim 1, wherein said backrest support includes a U-shaped support rod having parallel lateral rod portions which have upper ends pivoted to said intermediate portion of said backrest frame, and lower ends, and a connecting rod portion interconnecting said lower ends of said lateral rod portions and parallel to said horizontal bar, said retaining unit including:

a retaining seat fixed to said rear rod of said base frame and formed with a retaining groove for receiving said connecting rod portion of said backrest support, said retaining groove having an access opening which opens forwardly; and a limiting member mounted pivotally on said retaining seat so as to be rotatable relative to said retaining seat about a rotary axis parallel to said rear rod for moving between an unlocking position, in which said limiting member permits movement of said connecting rod portion of said backrest support into and out of said retaining groove via said access opening, and a locking position, in which said limiting member prevents removal of said connecting rod portion of said backrest support from said retaining groove when said connecting rod portion of said backrest support moves into said retaining groove.

4. The swing assembly as claimed in claim 3, wherein said retaining seat has a fixed plate portion fixed to said rear rod, and a pair of wing portions projecting forwardly from said fixed plate portion, each of said wing portions being generally U-shaped so as to define said retaining groove and said access opening, said limiting member having a lower end pivoted to said retaining seat, and an upper end formed with a pair of limiting hooks which project forwardly and downwardly, said limiting hooks hooking onto said connecting rod portion of said backrest support when said limiting member moves to the locking position.

* * * * *